US006805629B1

(12) United States Patent
Weiss

(10) Patent No.: US 6,805,629 B1
(45) Date of Patent: Oct. 19, 2004

(54) GAMING DEVICE AND METHOD

(75) Inventor: Steven A. Weiss, Las Vegas, NV (US)

(73) Assignee: Casino Data System, Las Vegas, NV (US)

( * ) Notice: Subject to any disclaimer, the term of this patent is extended or adjusted under 35 U.S.C. 154(b) by 0 days.

(21) Appl. No.: 09/661,163

(22) Filed: Sep. 13, 2000

(51) Int. Cl.[7] ..... A63F 9/24
(52) U.S. Cl. ..... 463/16; 273/138.1
(58) Field of Search ..... 463/6, 10, 16–22, 463/24–27, 30–32, 37, 42, 43; 273/138.1, 143 R

(56) References Cited

U.S. PATENT DOCUMENTS 5,114,157 A * 5/1992 Kita ..... 273/434
5,429,361 A * 7/1995 Raven et al. ..... 273/138 A
5,482,289 A * 1/1996 Weingardt ..... 273/269
5,547,202 A * 8/1996 Tsumura ..... 463/29
5,810,665 A * 9/1998 Takemoto et al. ..... 463/31
5,935,002 A * 8/1999 Falciglia ..... 463/19
6,203,429 B1 * 3/2001 Demar et al. ..... 463/20
6,203,430 B1 * 3/2001 Walker et al. ..... 463/20
6,398,645 B1 * 6/2002 Yoseloff ..... 463/19
6,450,884 B1 * 9/2002 Seelig et al. ..... 463/17
6,468,162 B1 * 10/2002 Nakamura ..... 463/43

FOREIGN PATENT DOCUMENTS

AU WO 98/20949 * 5/1998 ..... A63F/3/06

* cited by examiner

*Primary Examiner*—Kim Nguyen
(74) *Attorney, Agent, or Firm*—Bernhard Kreten, Esq.

(57) ABSTRACT

A method and device for gaming, in which an initial game is played toward an ultimate winning outcome, but with several intermediate winning outcomes possible before achieving the ultimate winning outcome. Several of these games may be played concurrently on the same device in pursuit of the ultimate winning outcome. Achieving the ultimate winning outcome may result in an award or in a subsequent gaming event. Play of a single gaming session need not take place in one sitting; the state of the current session may be saved, dispensed to the player in a physical form, and resumed at a later time.

20 Claims, 4 Drawing Sheets

GAMING DEVICE AND METHOD

FIELD OF THE INVENTION

The following invention is generally related to instrumentalities and methodologies in gaming devices. More specifically, the instant invention is directed to a gaming device having an ultimate winning outcome which allows the player to receive an award or to participate in a subsequent gaming event, and several intermediate winning outcomes in which the player is eligible for an award. Such a gaming device may be utilized as a single-player or a tournament play device. Most specifically, the instant invention is directed to such a gaming device which may engage in several gaming sessions at once, on which the state of play may be saved and dispensed to the player, play to be continued at a later time.

BACKGROUND OF THE INVENTION

Several games exist in the prior art that allow a player to play a game toward an ultimate winning outcome. These games, however, are quick to stagnate, as the player tires of repeatedly engaging in the same gaming proposition. In addition, such games are often over quickly, which does little to retain the player's interest. Games also exist in which a secondary gaming proposition is offered to the player if certain conditions are met. These may help to retain interest, but the duration of these games continues to be rather short. Players are more likely to walk away from such a game than if a game were long enough for a player to realize that more of a personal stake in gaming were involved.

SUMMARY OF THE INVENTION

The present invention is distinguishable over the prior art in a multiplicity of ways. For example, the instant invention provides a device and method for gaming in which a player is rewarded not only for an ultimate winning outcome, but also for any of several possible interim winning outcomes. In this way, the player is potentially rewarded multiple times on the road to the ultimate winning outcome. The reward for the ultimate winning outcome may be an award of credits or a complimentary item or items, or it may consist of a subsequent gaming proposition. This method and device is suitable for tournament play in addition to a single-player proposition.

In addition, this invention allows a player to engage in several gaming sessions concurrently, retaining player interest. Play of the game may be interrupted at any time; the state of play is then saved and the player may resume the same game or set of games at a future time. The state of play is saved and dispensed to the player, who may choose to continue the session later at that machine, or at any similar machine that allows such an event.

OBJECTS OF THE INVENTION

Accordingly, it is a primary object of the present invention to provide a new and novel device and method for gaming, in which a player is rewarded not only for an ultimate winning outcome, but for any of several intermediate winning outcomes.

It is a further object of the present invention to provide a device and method as characterized above which provides an award or a subsequent gaming proposition if the player achieves the ultimate winning outcome.

It is a further object of the present invention to provide a device and method as characterized above which allows a player to engage in several gaming sessions concurrently.

It is a further object of the present invention to provide a device and method as characterized above which provides the player with an option to save the state of the current game and resume playing at a future time.

It is a further object of the present invention to provide a device and method as characterized above which may be utilized not only as a single-player gaming proposition, but also as a gaming proposition suitable for tournament play.

Viewed from a first vantage point, it is an object of the present invention to provide a method for gaming, the steps including: making a wager to enable the gaming device, evoking chance means to produce a plurality of outcomes concurrently, displaying the plurality of outcomes, comparing each of the plurality of outcomes to an ultimate winning outcome, triggering a subsequent event if any of the plurality of outcomes matches the ultimate winning outcome, determining whether, if none of the plurality of outcomes matches the ultimate winning outcome, any of the plurality of outcomes matches an intermediate winning outcome, awarding credits if any of the plurality of outcomes matches an intermediate winning outcome, continuing to evoke chance means to produce subsequent pluralities of outcomes until said ultimate winning outcome is produced or until said subsequent outcomes are no longer possible, and saving the current set of said outcomes and said subsequent outcomes on encoded moveable media, said encoded moveable media dispensed to the player for later use.

Viewed from a second vantage point, it is an object of the present invention to provide a gaming device, comprising, in combination: a display, a processor operatively coupled to said display, including random output means appearing on said display, resulting in a plurality of outcomes, means for comparing each of said plurality of outcomes to a set of winning outcomes, said set of winning outcomes including an ultimate winning outcome and a plurality of intermediate winning outcomes, award means evoked if any of said plurality of outcomes matches one of said winning outcomes, including means to trigger a subsequent gaming event if any of said plurality of outcomes matches said ultimate winning outcome, continuance means for generating subsequent pluralities of outcomes, and saving means to store the state of play on encoded moveable media, including means to dispense said encoded moveable media for use at a later time.

These and other objects will be made manifest when considering the following detailed specification when taken in conjunction with the appended drawing figures.

DESCRIPTION OF PREFERRED EMBODIMENTS

Figure 2:
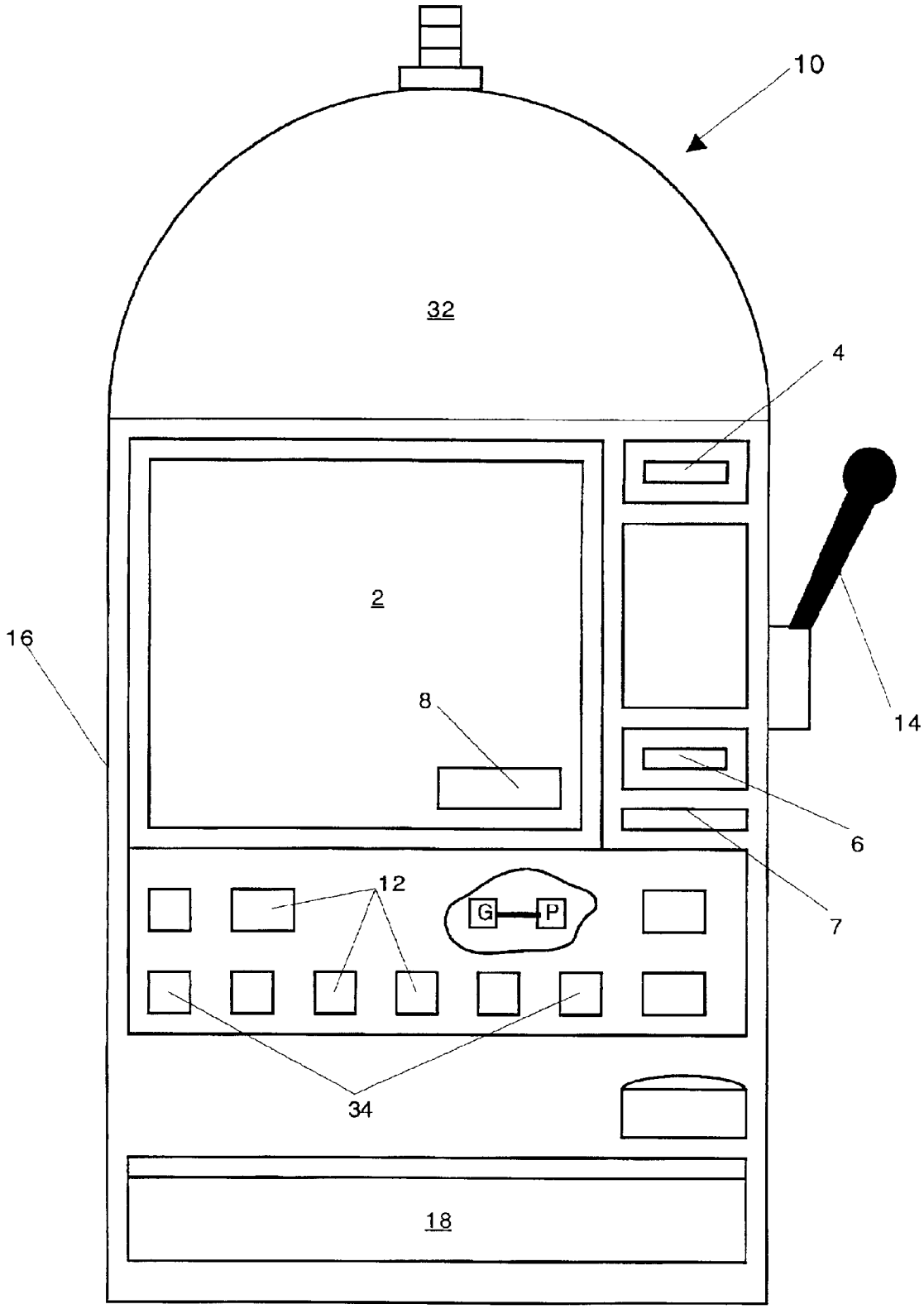
FIG. 2 is a depiction of the apparatus associated therewith.

Considering the drawings, wherein like reference numerals denote like parts throughout the various drawing figures, reference numeral 10 as shown in FIG. 2 is directed to the device according to the present invention.

In its essence, the device 10 includes a housing 16 which supports a visual display 2, preferably a video monitor, therewithin. The display 2 may include a window 8 for special messages or for incrementing counting of credits accumulated by the player. The device also includes an LED or other readout 4 for prompting the player and can provide similar verbiage as the window 8 or in lieu thereof, to stimulate the player. The device includes an inlet 6 for the reception therein for coins, currency or the like to auger in the inception of play. A separate slot 7, capable of accepting and dispensing encoded moveable media, is also present. A plurality of decision-making buttons 12 are located on the face of the apparatus 10, preferable below the display 2 and a pull handle 14 can be used to initiate play or as an alternative to supplement the decision-making buttons 12. A coin hopper 18 or ticket printer may be included to effectuate an output of an award due the player. The device 10 may have a top portion 32 with a display thereon having a motif correlative with the game to be played and can include a paytable. A plurality of speakers 34 may be included on the device for aural interaction with the player. The apparatus also includes a processor P coordinating all functions and a random number generator G operatively coupled thereto for generating outcomes.

Figure 3:
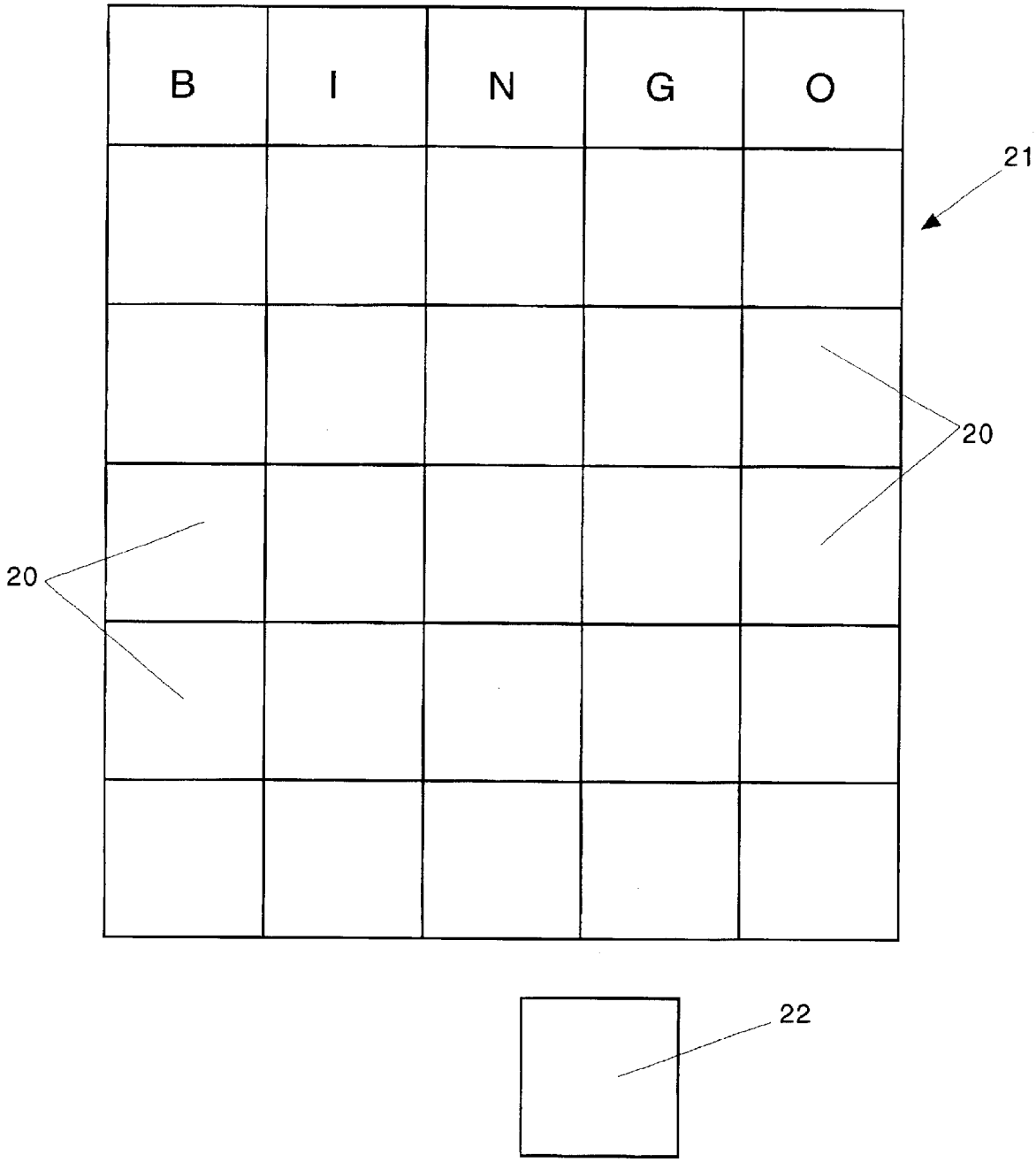
FIG. 3 is a depiction of the display screen shown in FIG. 2, depicting a plurality of randomly-numbered positions in a row and column (R×C) matrix.
Figure 4:
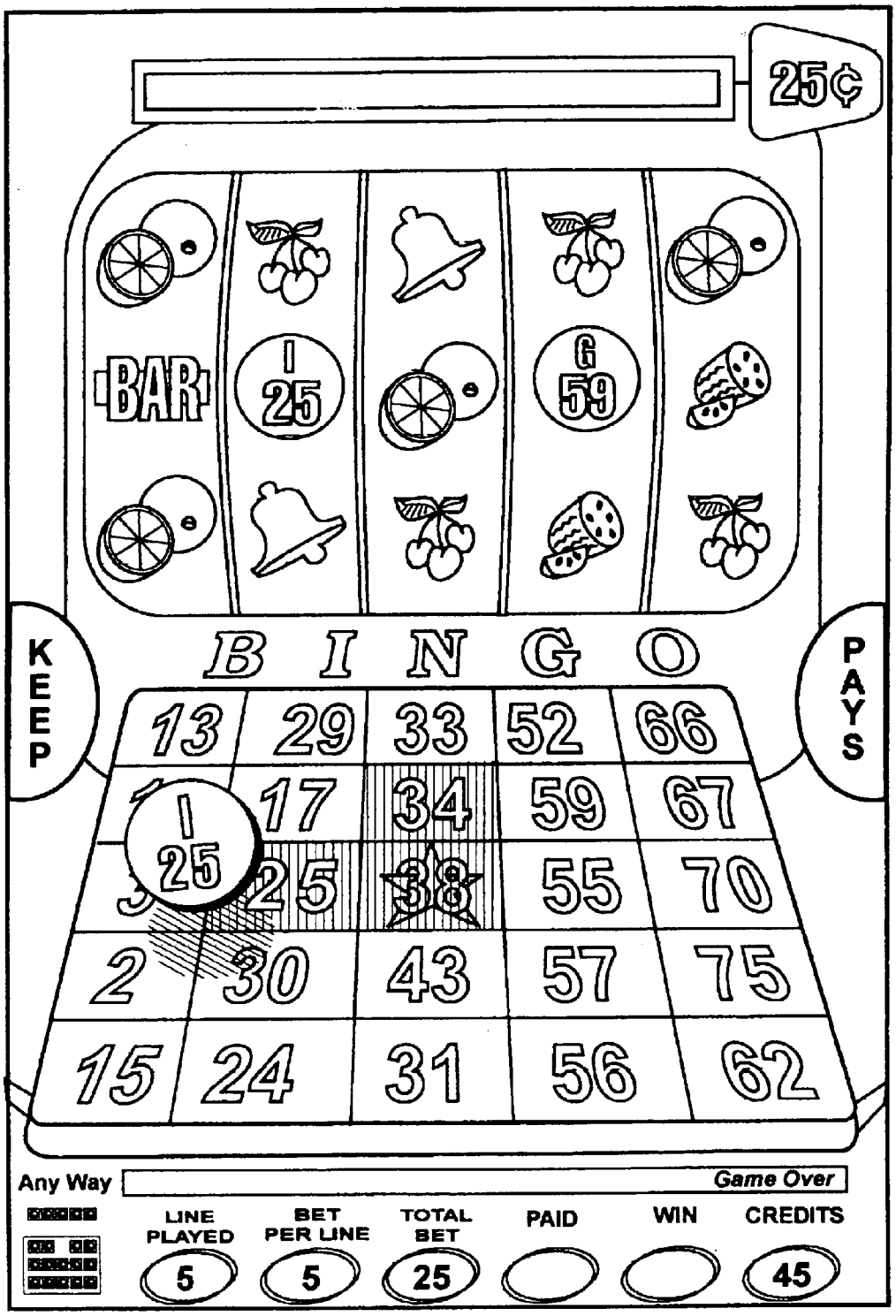
FIG. 4 is a 3D view of the display screen.

More specifically, and with reference to FIG. 3, greater details with respect to the video display 2 can be explored. In the preferred embodiment, the display 2 features a plurality of randomly-numbered positions 20 in a row and column (R×C) matrix 21. Numbers for play appear in box 22 and are randomly generated by random number generator G for play on the matrix 21. Preferably, the matrix defines a 5×5 array, correlative of BINGO, and above row one depicts the letters "BINGO", defining, with positions 20 an alpha numeric display. The display could also be three dimensional (3D) (FIG. 4).

Figure 1:
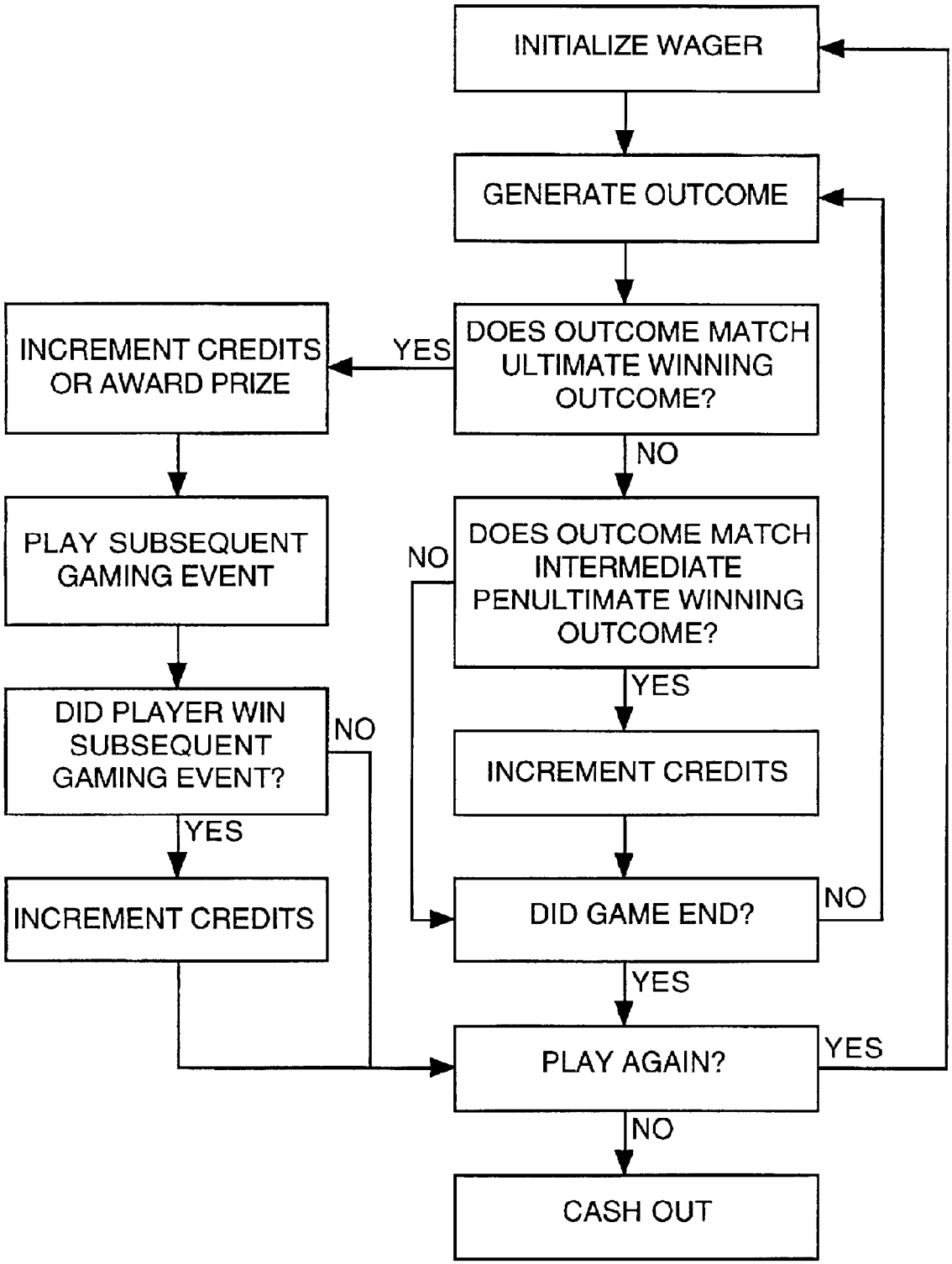
FIG. 1 is a flowchart of the methodology according to the present invention.

Thus, with BINGO, all positions 20 are initially nominated like a BINGO card. As "called" numbers appear in box 22, matches with positions 20 are highlighted Referring to FIG. 1, the flow chart associated with the apparatus of FIGS. 2 and 3 can be explored. In a single-player embodiment, the player engages in a gaming proposition using the display pictured of FIG. 3, on which a matrix 21 composed of randomly-numbered positions 20 is present. Randomly-generated numbers 22 appear on the display 2 and are compared to the numbers 20 on the matrix 21; if the numbers match, then that position appears bolded, highlighted or "covered" on the matrix 21. Each match (or non-match) can be a gaming proposition. The ultimate, maximum winning outcome in this embodiment is to cover all of the positions in the matrix. Before the entire matrix 21 is filled, there are opportunities to cover positions 20 in intermediate winning combinations, such as covering a certain number of positions 20 in a certain orientation, such as all in a row, all in a column, "four corners", etc. correlative of BINGO winning orientations. The player is awarded for these intermediate winning combinations as well as any match. Randomly-generated numbers continue to appear in box 22 on the display 2 until a predetermined number of numbers have been generated or until another preset event occurs, such as the expiration of time or predetermined number of wagers. If the player has not filled the matrix 21 at this point, the player loses, and has the option to play again, or to quit and cash out.

If the player succeeds in covering all the spaces in the matrix, an award of credits or other complimentary items is given. A player can increase enjoyment by playing multiple BINGO cards simultaneously on the display 2. Alternatively, or in addition, the player is then eligible to engage in a subsequent gaming proposition. These subsequent gaming propositions may take the form of "racing-style" events such as a simulated car or horse race or other gaming simulations such as Keno. The player may be awarded further for winning outcomes in these subsequent gaming propositions.

An example of one such game presents a player with a set of possible outcomes. The player is allowed to select a subset of possible outcomes. Actual outcomes are generated for the game, and the selected outcomes are compared to the actual game outcomes. The player is awarded for matching outcomes.

Players may save games which are not yet finished by using one of the decision-making buttons 12 to indicate that saving is desired. The device would then save the state of the game in present state of play, preferably via encoded moveable media such as a smart card or a card having a readable, writeable magnetic strip, and dispense it to the player through the slot 7. The player may take this saved game card and insert it into any compatible device at a future time, which would allow the player to continue the saved game at its present state when the player retired.

In a tournament situation, players would concurrently engage in the initial gaming proposition in competition with one another for example, as a function of time played or wagers made. Players could be eligible for intermediate prizes in this situation, even if they did not achieve the ultimate winning outcome. If no player in the tournament covered the entire BINGO card during the allotted tournament rule set, best performance would still be rewarded.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method for gaming, the steps including:

enabling a gaming device upon receipt of a wager, evoking chance means to produce a plurality of indicia to be used in a plurality of concurrent games said indicia combining to produce an outcome for each said concurrent game, at least one of said plurality of concurrent games having an ultimate winning outcome and a plurality of intermediate winning outcomes, displaying said indicia in said plurality of concurrent games, comparing each said outcome for each said concurrent games to said ultimate winning outcome, triggering an event subsequent to said plurality of concurrent games if any of said outcomes matches said ultimate winning outcome, determining whether, if none of said outcomes matches said ultimate winning outcome, any of said outcomes matches any of said plurality of intermediate winning outcomes in any of said plurality of concurrent games, awarding credits if any of said outcomes matches any of said plurality of intermediate winning outcomes, continuing to evoke chance means to produce subsequent pluralities of indicia until said ultimate winning outcome is produced or until said subsequent outcomes are no longer possible, and saving a current set of said outcomes and said subsequent outcomes on an encoded moveable media, said encoded moveable media dispensed to the player for later use.

2. The method of claim 1 further including the step of producing randomly-generated numbers corresponding to a randomly-numbered playfield oriented in a row-and-column (RXC) matrix, and wherein said ultimate winning outcome consists of matching all of said randomly-generated numbers to said randomly-numbered playfield.

3. The method of claim 2 further including the step of awarding a player for matching a subset of the numbers in said randomly-numbered playfield to said randomly-generated numbers if said ultimate winning outcome is not attained.

4. The method of claim 3 further including the step of configuring said subsequent event to include the steps of:

awarding credits, and engaging in a subsequent gaming event.

5. The method of claim 4 further including the step of configuring said subsequent gaming event to include the steps of:

allowing a player to select a subset of outcomes from a set of possible outcomes, generating outcomes, comparing said selected subset of outcomes with said generated outcomes, and awarding credits according to a paytable for matches between said selected subset of outcomes and said generated outcomes.

6. The method of claim 4 further including the step of configuring said subsequent gaming event to include the step of simulating a racing event.

7. The method of claim 3 wherein only a single player is involved.

8. The method of claim 3 wherein a plurality of players may participate in concurrent gaming sessions in competition with each other.

9. The method of claim 2 further including the step of configuring said subsequent event to include the steps of:

awarding credits, and engaging in a subsequent gaming event.

10. The method of claim 9 further including the step of configuring said subsequent gaming event to include the steps of:

allowing a player to select a subset of outcomes from a set of possible outcomes, generating outcomes, comparing said selected subset of outcomes with said generated outcomes, and awarding credits according to a paytable for matches between said selected subset of outcomes and said generated outcomes.

11. The method of claim 9 further including the step of configuring said subsequent gaming event to include the step of simulating a racing event.

12. The method of claim 2 further including the step of forming said R×C matrix as a three dimensional array.

13. The method of claim 1 further including the step of configuring said subsequent event to include the step of awarding credits.

14. The method of claim 1 further including the step of configuring said subsequent event to include the step of awarding a plurality of complimentary items other than credits.

15. The method of claim 1 further including the step of configuring said subsequent event to include the step of engaging in a subsequent gaming event.

16. The method of claim 1 further including the step of configuring said subsequent event to include the steps of:

awarding credits, and engaging in a subsequent gaming event.

17. The method of claim 16 including the step of configuring said subsequent gaming event to include the step of simulating a racing event.

18. The method of claim 16 further including the step of configuring said subsequent gaming event as Keno.

19. A gaming device, comprising, in combination:

a display, a processor operatively coupled to said display, said processor including and activating random output means, said random output means generating indicia, said indicia combining to produce a plurality of outcomes, appearing on said display, applicable to a plurality of concurrent games, means for comparing each of said plurality of outcomes to a set of winning outcomes for each of said plurality of concurrent games, said set of winning outcomes including, for at least one of said plurality of concurrent games, an ultimate winning outcome and a plurality of intermediate winning outcomes, award means evoked if any of said plurality of outcomes matches one of said winning outcomes on any of said plurality of concurrent games, including means to trigger a subsequent gaming event if any of said plurality of outcomes matches said ultimate winning outcome, continuance means for generating subsequent pluralities of outcomes, and saving means to store the state of play on an encoded moveable media, including means to dispense said encoded moveable media for use at a later time.

20. A method for gaming, the steps inducing:

enabling a gaming device upon receipt of a wager;

evoking chance means to produce indicia, said indicia combining to produce a plurality of outcomes to be used in a plurality of concurrent games, at least one of said plurality of concurrent games having an ultimate winning outcome and a plurality of intermediate winning outcomes, displaying said plurality of outcomes in said plurality of concurrent games, comparing each of said plurality of outcomes for each of said plurality of concurrent games to said ultimate winning outcome, triggering an event subsequent to said plurality of concurrent games if any of said plurality of outcomes matches said ultimate winning outcome, wherein said subsequent event comprises:

awarding credits, and engaging in a subsequent gaming event, wherein said subsequent gaming event comprises:

allowing a player to independently select a subset of outcomes from a set of possible outcomes, generating outcomes, comparing said selected subset of outcomes with said generated outcomes, and awarding credits according to a paytable for matches between said selected subset of outcomes and said generated outcomes;

determining whether, if none of said plurality of outcomes matches said ultimate winning outcome, any of said plurality of outcomes matches any of said plurality of intermediate winning outcomes;

awarding credits if any of said plurality of outcomes matches any of said plurality of intermediate winning outcomes;

continuing to evoke the chance means to produce subsequent pluralities of outcomes until said ultimate winning outcome is produced or until said subsequent outcomes are no longer possible; and saving a current set of said outcomes and said subsequent outcomes on encoded moveable media, said encoded moveable media dispensed to the player for later use.

* * * * *